US005238073A

United States Patent [19]

Rear

[11] Patent Number: 5,238,073

[45] Date of Patent: Aug. 24, 1993

[54] UPHOLE HAMMER

[76] Inventor: Ian G. Rear, 60 Clavering Rd., Bayswater WA 6053, Australia

[21] Appl. No.: 862,512

[22] Filed: Apr. 2, 1992

[30] Foreign Application Priority Data

Apr. 4, 1991 [AU] Australia ..... PK 5476

[51] Int. Cl.[5] ..... E21B 4/14; E21B 7/28; E21D 3/00

[52] U.S. Cl. ..... 175/53; 175/19; 175/92; 175/296

[58] Field of Search ..... 175/53, 19, 92, 296

[56] References Cited

U.S. PATENT DOCUMENTS

| | | | |
|---|---|---|---|
| 3,730,283 | 5/1973 | Kostyler et al. | 175/53 |
| 4,249,620 | 2/1981 | Schmidt | 175/53 |
| 4,384,624 | 5/1983 | Duke et al. | 175/19 |
| 4,410,053 | 10/1983 | Masse | 175/53 |
| 4,878,547 | 7/1989 | Lennon | 175/53 |
| 4,921,052 | 1/1990 | Rear | 173/78 |
| 5,090,487 | 2/1992 | Masse | 173/111 |
| 5,096,000 | 3/1992 | Hesse | 175/22 |
| 5,127,481 | 7/1992 | Hesse | 175/295 |

FOREIGN PATENT DOCUMENTS 2137720 10/1984 United Kingdom .

*Primary Examiner*—Hoang C. Dang

*Attorney, Agent, or Firm*—Merchant & Gould, Smith, Edell, Welter & Schmidt

[57] ABSTRACT

An uphole hammer is provided comprising a substantially tubular housing which is closed at a first end and supports a substantially centrally located fluid supply tube at the first end. The fluid supply tube extends axially through the housing and is adapted to be mounted at its other end to a drill string, the fluid supply tube being adapted to receive fluid being directed to the hammer by the drill string. The housing further supports a drill bit at or towards its other end which is slidably received about the fluid supply tube, a piston also being slidably supported about the fluid supply tube in the housing for reciprocation between the drill bit and the first end of the housing. A fluid port is also provided to alternatively admit fluid to the spaces defined between each end of the piston and the respective ends of the housing to effect reciprocation of the piston between a first position at which it impacts on the drill bit and a second position at which it lies in the vicinity of the first end of the housing.

20 Claims, 7 Drawing Sheets

UPHOLE HAMMER

This invention relates to the drilling of bore holes.

The present invention relates to a hammer, which for the sake of convenience shall be referred to as an "uphole hammer", which can be used to increase the diameter of a bore hole that has been created between two zones such as two shafts or tunnels. In use, it is intended that the uphole hammer be mounted to the end of a drill string that has been passed through the bore hole into one of the zones, such that on operation, the uphole hammer can be moved along the bore hole towards the other zone by withdrawing the drill string from the bore hole. This action results in the diameter of the bore hole being increased to the diameter of the uphole hammer.

The present invention resides in an uphole hammer comprising a substantially tubular housing which is closed at one end and supports a substantially centrally located fluid supply tube at said one end, wherein said fluid supply tube extends axially through the housing and is adapted to be mounted at its other end to a drill string, said fluid supply tube being adapted to receive fluid being directed to the hammer by the drill string, said housing further supporting a drill bit support at or towards its other end which is slidably received about the fluid supply tube, a piston also being slidably supported about the fluid supply tube in the housing for reciprocation between the drill bit support and said one end of the housing, and fluid porting means being provided to alternately admit fluid to the spaces defined between each end of the piston and the respective ends of the housing to effect reciprocation of the piston between a first position at which it impacts on the drill bit support and a second position at which it lies in the vicinity of said one end of the housing.

The invention will be more fully understood in the light of the following description of one specific embodiment. However, it will be understood that this description is not to limit the generality of the above description. The description is made with reference to the accompanying drawings of which:

Figure 1:
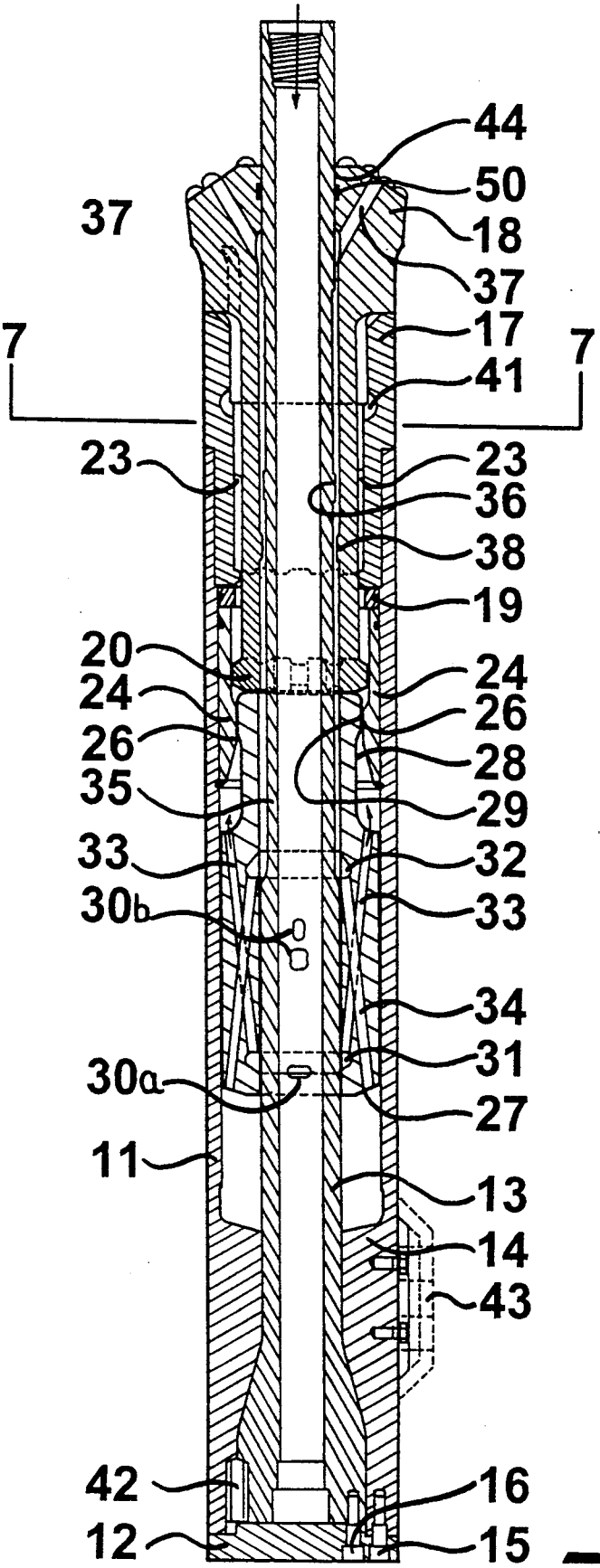
FIG. 1 is a sectional side elevation of an uphole hammer according to a first embodiment of the invention in the impact position.

The illustrated embodiment is directed to an uphole hammer which is to be used in reaming a bore hole which has already been formed between two zones to increase the diameter of the bore hole. It is envisaged that the hammer will be used in an orientation at which it is required to move upwardly from one zone to another. The bore hole can be vertical or at any inclination between a horizontal axis and vertical axis.

The embodiment comprises a substantially tubular housing 11 which is closed at one end thereof by an end plate 12. The housing 11 supports a central fluid supply tube 13 which is fixed to the one end of the housing 11 to extend substantially centrally and axially through the housing 11 beyond the other end of the housing 11. The free end of the fluid supply tube 13 is adapted to be mounted to a drill string (not shown).

To retain the fluid supply tube 13 within the housing 11 the internal face of the housing 11 in the region spaced inwardly from the one end thereof is formed with a reduced diameter portion 14. The axial face of the reduced diameter portion 14 is formed to be gradually divergent to provide a gradual taper towards the one end. The one end of the fluid supply tube 13 has a configuration which is complementary to the cross sectional configuration of the housing 11 in the region of the reduced diameter portion thereof. This serves to prevent axial displacement of the fluid supply tube 13 towards the other end of the housing.

The end plate 12 is received over the one end of the housing 11 to close that end and is fixed to the one end by a first set of circumferentially spaced studs 15. In addition, the end plate 12 is fixed to the one end of the fluid supply tube 13 by a second set of circumferentially spaced studs 16.

Rotation of the fluid supply tube 13 within the housing 11 is prevented by the presence of an axially directed key 42 which is received in complementary grooves provided in the opposed faces of the fluid supply tube 13 and housing 11 in the region of the one end thereof.

The other end of the housing 11 supports a drill bit 18 located within a drive sub-bit support 17 which is threadably or otherwise fixed to the housing 11.

Alternatively, the drill bit 18 may be formed as an integral component thereof. The drill bit 18 is retained in the drive sub-bit support 17 through a bit retaining ring 19 which is supported from the internal face of the housing 11 at a location spaced inwardly from the other end thereof. The drill bit 18 is formed at its innermost end with a set of circumferentially spaced lugs 20 which are engageable with the bit retaining ring 19 in order that they cannot be moved outwardly beyond the bit retaining ring 19, thus serving to limit the degree of outward movement of the drill bit 18 from the drive sub-bit support 17.

Figure 6:
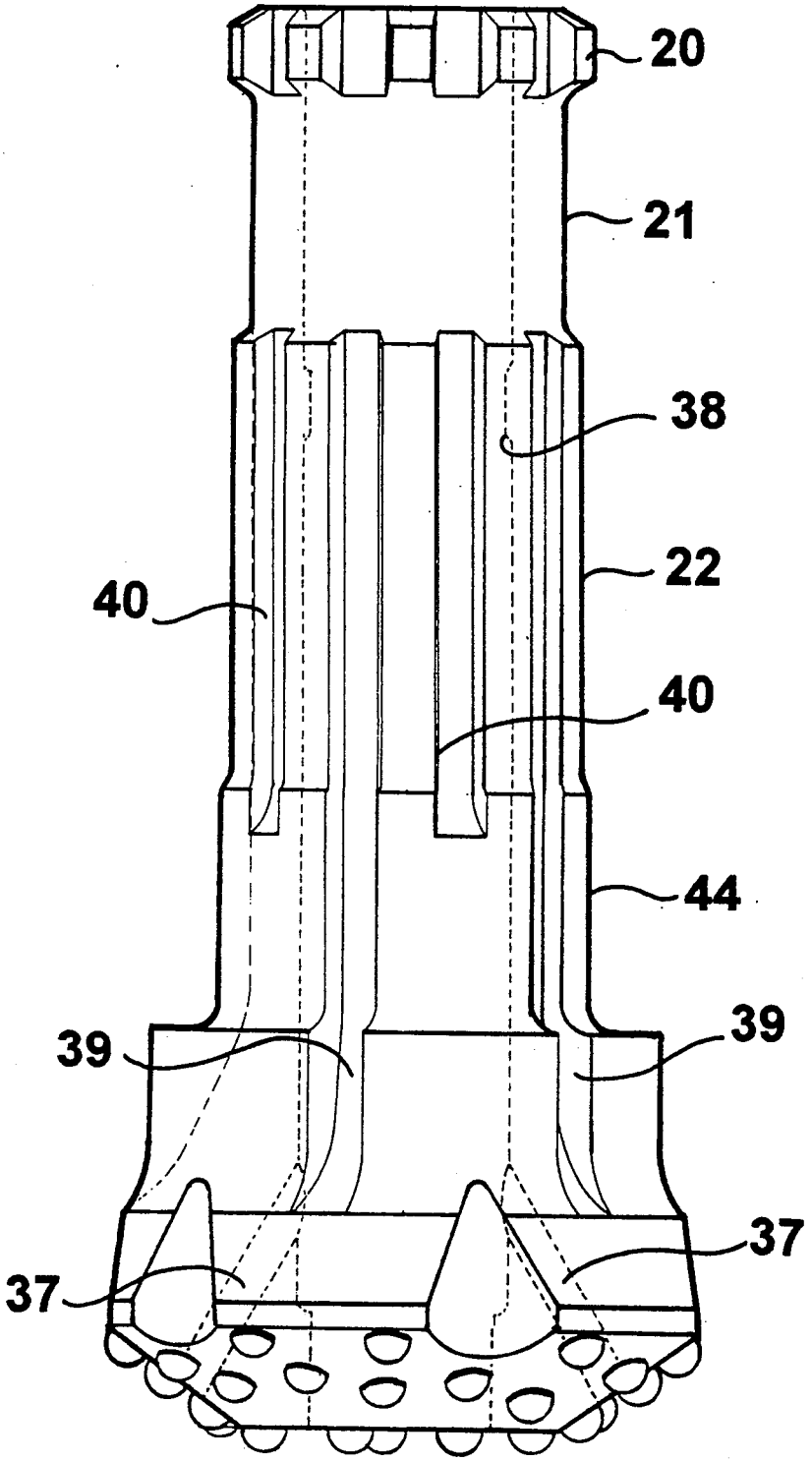
FIG. 6 is a side elevation of a drill bit support according to the embodiment of FIG. 1.

As shown in FIG. 6 the support 17 is formed with a waisted portion 21 adjacent the lugs 20 and beyond the waisted portion is formed with a plurality of axial splines 22 which are substantially coaxial with the lugs 20. The splines 22 and the lugs 20 are slidably received in complementary splines 23 provided on the internal face of the drive sub-bit support 17. This enables the drill bit 18 to slide axially within the drive sub-bit support 17 and the housing 11 but serves to prevent relative rotation of the drill bit 18 with respect to the housing 11 and drive sub-bit support 17.

Figure 7:
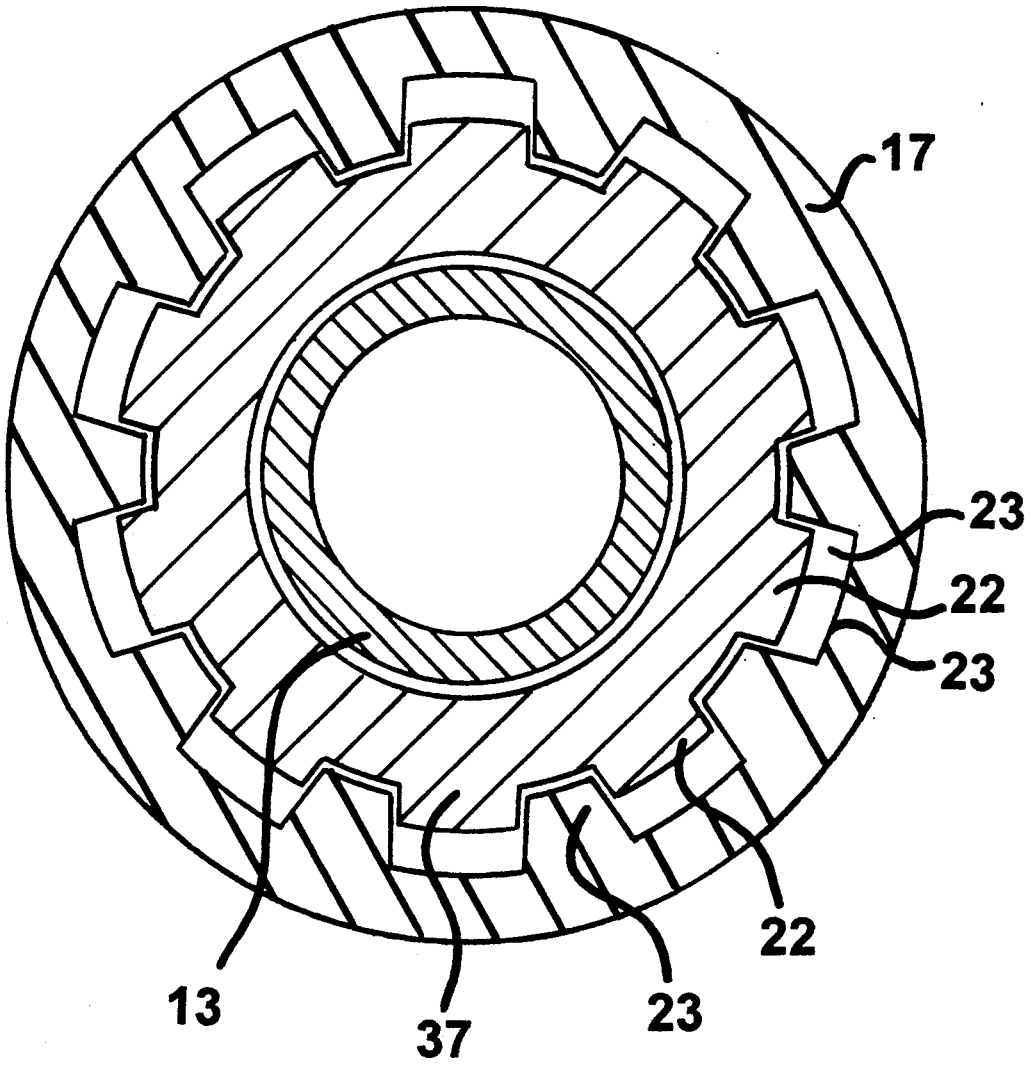
FIG. 7 is a cross-section along line 7—7 of FIG. 1.

As shown at FIG. 7, the diameter of the crest of the splines 22 provided on the drill bit 18 is preferably less than the depth of the space provided between the splines 23 in the drive sub-bit support providing a space **23*b* between the splines 22 and the root of the spline 23*a* of the drive sub-bit support through which air can be exhausted from the piston chambers formed by the piston 27 with the housing 11**.

The internal face of the housing 11 inward of the retaining ring 19 supports an annular sleeve 24. At its innermost end the sleeve 24 is formed with a rib 26.

The space between the innermost axial face of the reduced diameter portion 14 of the housing 11 and the rib 26 of the sleeve 24 provide the piston chamber for the hammer. The piston 27 is slidably received within the piston chamber to be slidably and sealingly received over the fluid supply tube 13 and slidably and sealingly received by the inner face of the housing 11. The end of the piston 27 adjacent the drive sub-bit support 17 is formed with a reduced diameter portion 28 which is provided at its outermost end with a rib 29 of complementary diameter to the rib 26 provided on the sleeve 24. This provides a substantial sealing inter-engagement therebetween.

The fluid supply tube 13 is provided with first and second sets of fluid outlet ports 30*a* and 30*b* which are spaced axially along the length of the fluid supply tube 13. The internal bore of the piston 27 is formed with a pair of annular grooves 31 and 32 which are spaced axially from each other. One of the annular grooves 31 is associated with a set of substantially axially directed first passageways 33 which open into the axial face formed by the waisted portion 28 on the piston. The other annular groove 32 is formed with a set of substantially axially directed second passageways 34 which open into the face of the piston adjacent the one end of the housing.

Figure 3:
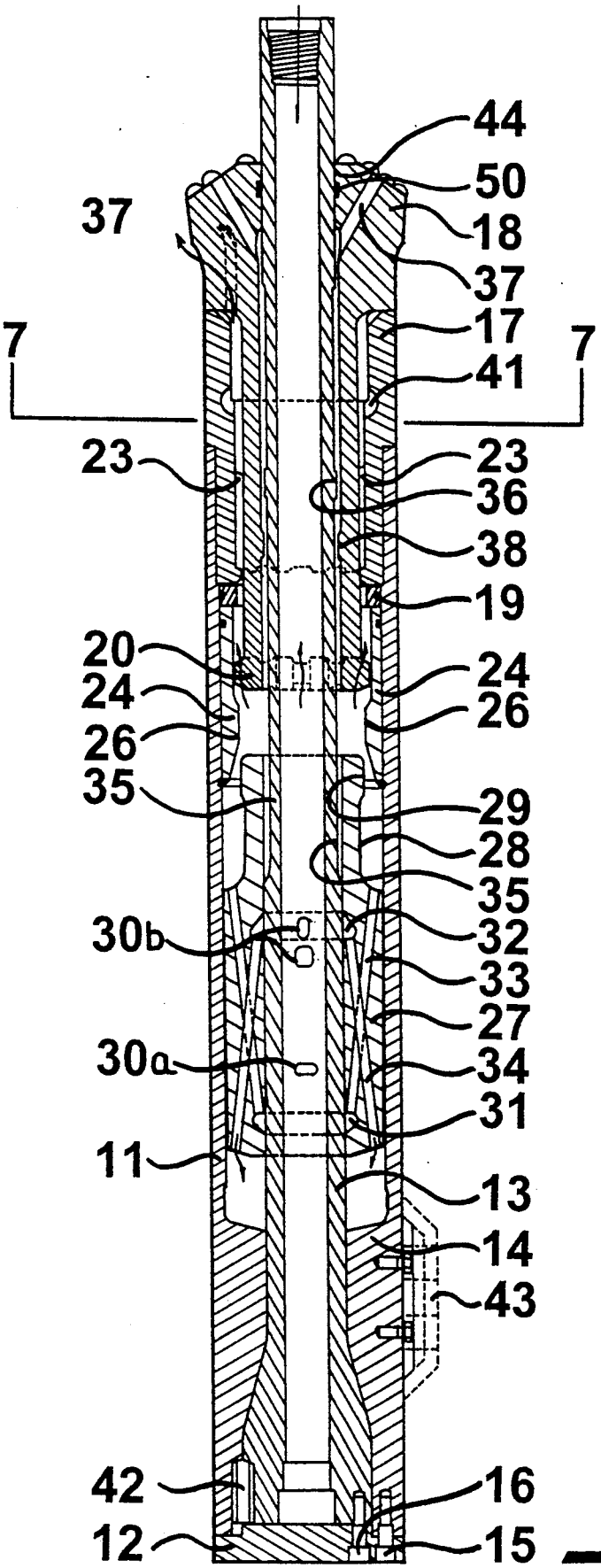
FIG. 3 is a sectional side elevation of the embodiment of FIG. 1 showing the piston at an intermediate position between the positions shown in FIGS. 1 and 2.
Figure 4:
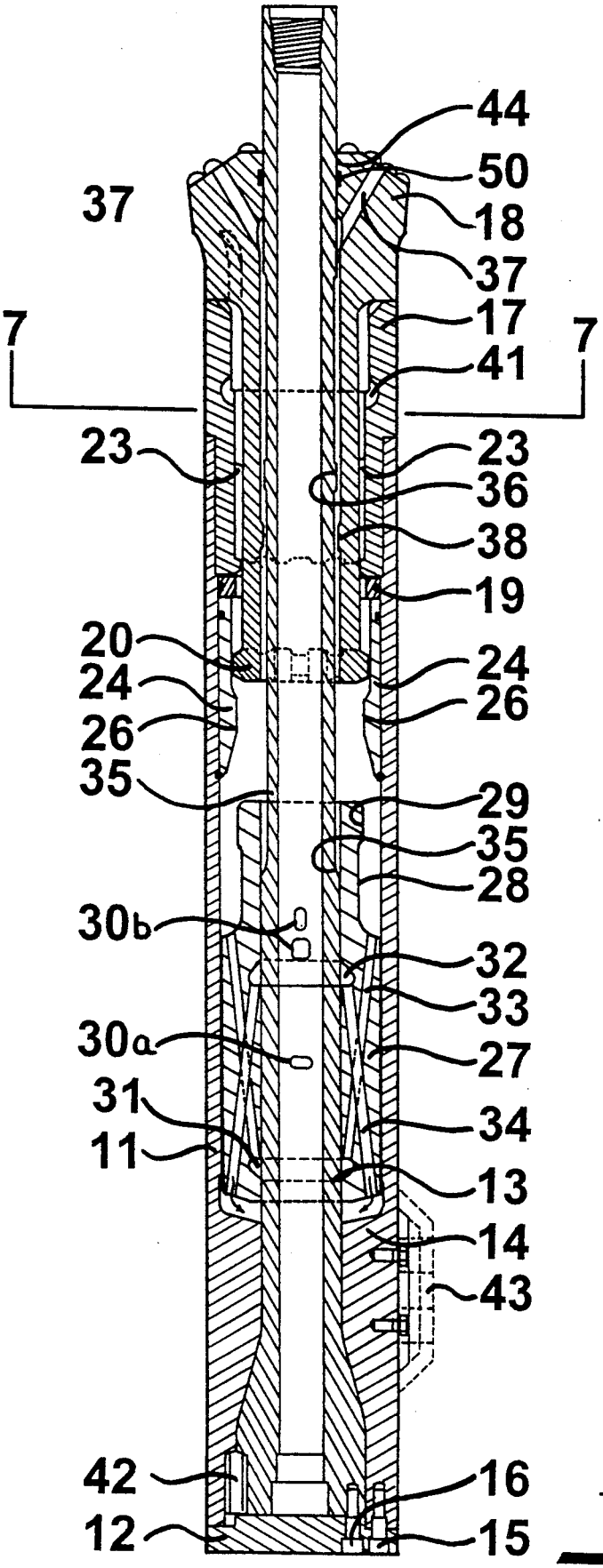
FIG. 4 is a sectional side elevation of the embodiment of FIG. 1 showing the piston located adjacent said one end of the housing.
Figure 5:
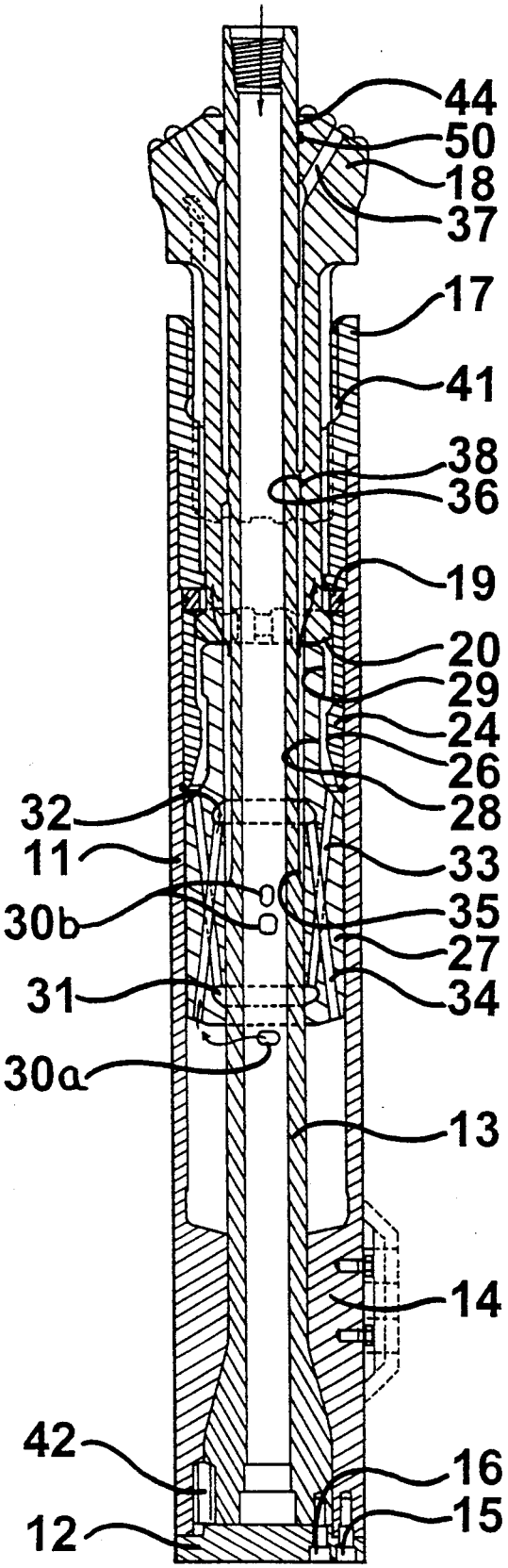
FIG. 5 is a sectional side elevation of the embodiment of FIG. 1 in its non-operating mode.

The first annular groove 31 communicates with the first set of fluid ports 30*a* in the fluid supply tube 13 when the piston is at its impact position as shown in FIG. 1. In this impact position, the other end of the piston is in abutting engagement with the lowermost end of the drill bit 18, and also for a short period of initial movement of the drill bit 18 away from the drive sub-bit support 17 as shown at FIG. 5. The second set of fluid inlet ports 30*b* comprises two subsets of axially spaced ports. The second annular groove 32 comes into engagement with the second set of ports 30*b* as the piston approaches the one end of the housing as shown at FIGS. 3 and 4. The axial spacing of the two subsets of ports serves to ensure that fluid is delivered to the piston chamber space between the one end of the housing and the one end of the piston over an extended period of time, and that the fluid pressure is maximised as the piston reaches its innermost position in close proximity to the one end. The spacing of the fluid ports further ensures that fluid pressure is maintained in that chamber space for a significant portion of the travel of the piston towards the drill bit 18.

Figure 2:
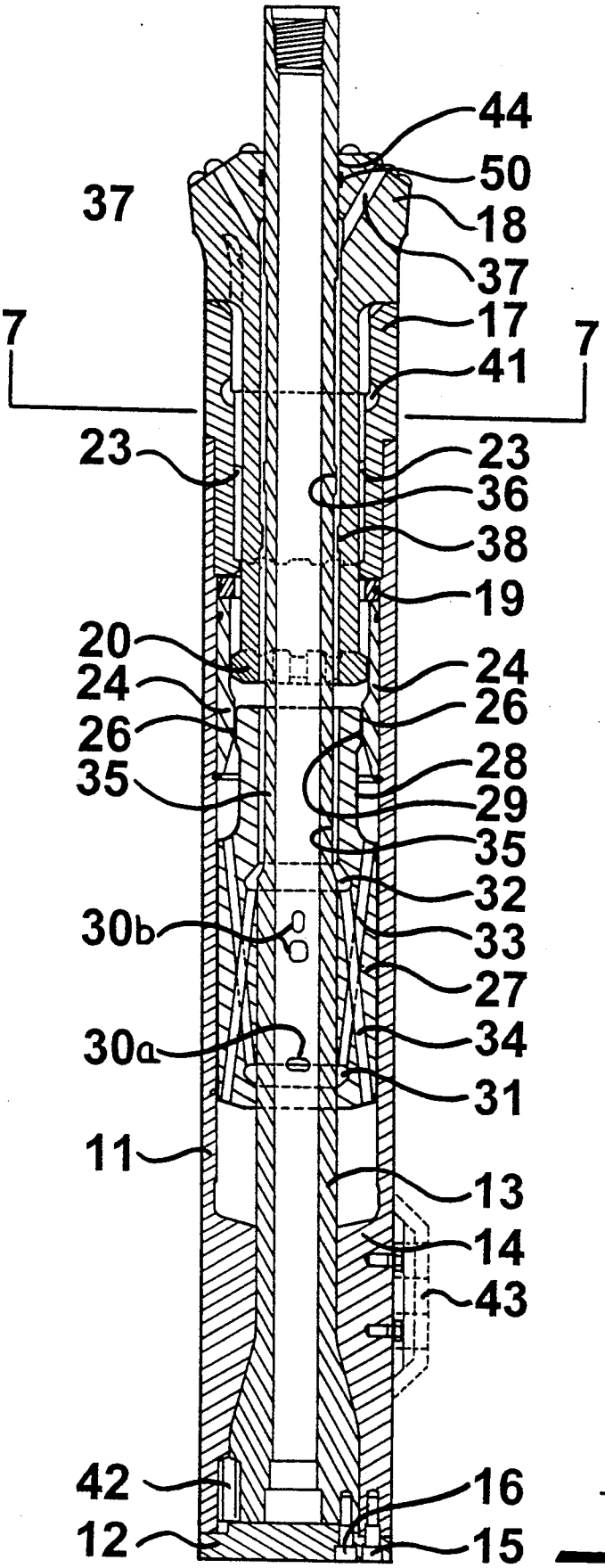
FIG. 2 is a sectional side elevation of the embodiment of FIG. 1 where the piston is adjacent the impact position.

When at the impact position as shown at FIG. 1 fluid is injected into the piston chamber space provided between the waisted portion 28 of the piston 27 and the annular sleeve 24 supported within the housing to cause the piston to be forced towards the one end of the housing. This force is maintained for as long as there is sealing engagement between the rib 26 provided on the sleeve 24 and the rib 29 provided on the outermost end of the piston 27 (see FIG. 2).

Disengagement between the ribs 26 and 29 on the housing and piston respectively (see FIG. 3) allows the pressurized fluid which was previously entrapped in the chamber space between the waisted portion 28 of the piston and the housing to escape through the space 23*b* provided between the interior walls of the housing 11 and the splines 22 of the drill bit 18 and the splines 23*a* of the drive sub-bit support 17. As the piston moves towards the one end of the housing, the second annular groove 32 comes into engagement with the second set of ports 30 (see FIG. 3) causing fluid to be injected into the chamber space between the one end of the housing 11 and the one end of the piston 27.

Fluid continues to be injected until the piston reaches its lowermost position in proximity with the inner end of the housing 11. The pressure generated within that chamber space then causes the movement of the piston back towards the drill bit 18. The pressure is maintained until the second annular groove 32 comes into engagement with a waisted portion 35 provided on the exterior surface of the fluid supply tube 13 which is at a position immediately prior to the piston reaching its impact position shown at FIG. 1.

The presence of the waisted portion 35 permits fluid pressure generated in the space between the one end of the piston 27 and the one end of the housing 11 to be exhausted therefrom to between the internal bore of the piston 27 and the exterior of the fluid supply tube 13 and between the internal bore of the drill bit 18 and fluid supply tube 13 and out of the holes 37 of the drill bit 18. As the piston moves away from the bit 18, fluid is also exhausted past the bit splines 20 and through the space 23*b* formed between the splines 22 of the bit and 23*a* of the drive sub-bit support. The fluid ports 37 are not necessary but may also be of assistance in clearing cuttings from the cutting face.

The fluid supply tube 13 has its waisted portion 35 at a location intermediate the innermost axial face of the reduced diameter portion 14 of the housing 11 and the sleeve 24, whereby the diameter of the fluid supply tube 13 beyond the waisted portion 35 is substantially constant, with the exception of an intermediate rib 36 provided in the region of the drill bit support 17. The internal bore of the drill bit 18 for most of its length is greater than that of the waisted portion 35 of the fluid supply tube 13 to provide for clearance between the two surfaces and to enable the exhaustion of fluid from the piston chamber through that space. However, the internal diameter of the outermost end of the drill bit 18 is of a diameter complementary to that of the fluid supply tube 13 such that there is a substantial sealing engagement therebetween.

Fluid ports 39 are provided in the outer face of the drill bit 18 which extend between the outer face of the drill bit 18, from the space 23*b* formed between the bit splines 22 and 23*a* of the drive sub-bit support 17, and the region of the drive sub bit support 17 that is in non-sealing engagement with the external surface 44 of the drill bit 18. This permits the exhaustion of fluid from the piston chamber.

When the second annular groove 32 engages with the waisted portion 35 of the fluid supply tube 13, the fluid in the piston chamber between the one end of the housing 11 and the one end of the piston 27 is further exhausted both between the drill bit 18 and the fluid supply tube 13 and the holes 37 of the drill bit, and within the space 23*b* formed between the bit splines 22 and the splines 23*a* of the drive sub-bit support 17 when the piston is not in contact with the drill bit 18 at impact.

With the repeated impacting of the piston 27 on the drill bit 18, the drill bit 18 is caused to reciprocate over the fluid supply tube 13 and within the drive sub-bit support 17 in accordance with the impacting force and the rock condition in which the drill bit 18 is operating.

On the hammer being moved away from the cutting face, the absence of any force being applied to the cutting face of the drill bit 18 causes the drill bit 18 to be moved to its outermost position within the drive sub-bit support 17 as the piston moving to its impact position (as shown in FIG. 5). With continued movement of the piston 27 in the direction of the drill bit 18, the first set of fluid ports 30*a* on the fluid supply tube 13 come into direct open communication with the space defined between the one end of the housing 11 and the one end of the piston 27 to generate a fluid pressure therein which maintains the piston at that outermost position. The fluid pressure is exhausted from the space through the second set of axial passageways 34, the second annular groove 32, and between the waisted portion 35 of the fluid supply tube 13 and the internal bore of the piston 27.

The internal bore of the drill bit 18 is formed with an annular rib 38 at an intermediate position, which, when the piston is in its outermost position as shown at FIG. 5, is in a substantial sealing engagement with the intermediate rib 36 provided on the waisted portion 35 of the fluid supply tube 13. This assists in preventing escape of fluid between the internal face of the drill bit 18 and the fluid supply tube 13. In addition, the piston 27 is forced into face to face engagement with the lower end of the drill bit 18 as a result of the fluid pressure being exerted on the one end of the piston 27 which prevents the escape of fluid between the splines 22 and 23*a* provided on the drill bit and the drive sub-bit support respectively. As a result of this action, sufficient fluid pressure is generated to retain the drill bit 18 in its outermost position in the drive sub-bit support against the influence of gravity with the bit lugs 20 in abutment with the bit retaining rings 19.

To recommence drilling the drill string is moved into the bore hole to bring the drill bit into engagement with the front of the material to be cut and the subsequent movement of the drill bit 18 within the housing 11 and drive sub-bit support 17 causes movement of the piston 27 to its impact position shown at FIG. 1 which results in the continued reciprocation of the piston 27 within the housing 11 as described above.

As shown more clearly at FIG. 6 the spaces 23*b* provided between the splines 22 of the drill bit and splines 23*a* of the drive sub-bit support may be formed of varying axial lengths such that one half of the faces extend to a position almost adjacent the cutting face of the drill bit 18, while the other half may terminate well short of the cutting face. In either case this space serves to ensure that the flow rate of air exhausted from the drill bit 18 through the fluid ports, 39 adjacent the cutting face through the set of spaces is sufficient to facilitate a greater clearance of cuttings from between the hammer and the bore hole. It is preferable that one half of the splines 22 of the drill bit are formed of varying axial lengths. This reduction in the number of openings into the bore hole reduces the possibility of the ingress of cuttings into the hammer when the hammer is non-operative.

The interior of the housing 11 is also preferably formed with an internal annular recess 41 which provides for communication between the two sets of spaces 40 and 39 and allows for the escape of air from the shorter spaces 40 to the longer fluid ports 39. Furthermore, stabilising pads 43 may be provided to the outside diameter adjacent the one end of the housing 11 to centralise the one end of the housing 11 within the bore hole. Further still, a replaceable bush bearing 50 may be located in the drill bit in location 44 between the drill bit 18 and the fluid supply tube 13 if necessary. The bush bearing 50 may be of any suitable material such as any appropriate metallic or synthetic material.

It should be appreciated that the invention need not be limited to the particular scope of the embodiment described above. In particular while a particular means of fluid delivery and exhaustion for effecting recriprocation of the piston has been described in relation to the embodiment the invention need not be so limited. In addition the invention need not be restricted to a circumstance where the hammer is drilling upwardly within a bore hole.

I claim:

1. An uphole hammer comprising a substantially tubular housing which is closed at one end and supports a substantially centrally located fluid supply tube at said one end, wherein said fluid supply tube extends axially through the housing and is adapted to be mounted at its other end to a drill string, said fluid supply tube being adapted to receive fluid being directed to the hammer by the drill string, said housing further supporting a drill bit at or towards its other end which is slidably received about the fluid supply tube, a piston also being slidably supported about the fluid supply tube in the housing for reciprocation between the drill bit and said one end of the housing, and fluid porting means being provided to alternately admit fluid to the spaces defined between each end of the piston and the respective ends of the housing to effect reciprocation of the piston between a first position at which it impacts on the drill bit and a second position at which it lies in the vicinity of said one end of the housing.

2. An uphole hammer according to claim 1 wherein the fluid porting means is provided between the fluid supply tube and piston.

3. An uphole hammer according to claim 1 wherein the internal surface of the housing is formed with a reduced diameter portion at said one end, said reduced diameter portion being adapted to be gradually divergent to provide a gradual taper towards said one end.

4. An uphole hammer according to claim 3 wherein said one end of the fluid supply tube has an external surface configuration complementary to the gradually tapered portion of the housing to prevent axial displacement of the fluid supply tube towards the other end of the housing.

5. An uphole hammer according to claim 4 wherein rotation of the fluid supply tube within the housing is prevented by the provision of at least one axially directed key received in complementary grooves provided in opposed faces of the fluid supply tube and housing at said one end.

6. An uphole hammer according to claim 5 wherein the drill bit is substantially elongate having a cutting face integrally located at the outermost end thereof and having a set of circumferentially spaced lugs arranged thereabout at the lowermost end thereof.

7. An uphole hammer according to claim 6 wherein the drill bit is retained in a drive sub-bit support and the housing by a bit retaining ring arranged within the internal face of the housing at a location spaced inwardly from the other end thereof, such that the bit retaining ring prevents the circumferentially spaced lugs of the drill bit from moving therepast to limit the degree of outward movement of the bit from the drill sub-bit support and housing.

8. An uphole hammer according to claim 7 wherein the drill bit is provided with a plurality of axial splines arranged substantially coaxially with the circumferentially spaced lugs and located between the circumferentially spaced lugs and the cutting face, the drill bit further including a waisted portion located between the plurality of axial splines and the circumferentially spaced lugs.

9. An uphole hammer according to claim 8 wherein the splines of the drill bit are formed of varying axial lengths such that all or some portion of the splines extend to a position almost adjacent the cutting face of the drill bit, some of the other splines terminating short of the cutting face.

10. An uphole hammer according to claim 9 wherein the drill bit splines and lugs are slidably receivable in complementary splines provided on the internal face of the drive sub-bit support attached into the housing such that the drill bit support is capable of sliding axially within the drive sub-bit support and the housing but such that relative rotation of the drill bit with respect to the housing is prevented.

11. An uphole hammer according to claim 10 wherein the diameter of the splines on the drill bit is less than the diameter of the complementary splines on the internal face of the drive sub-bit support, providing a space between the drill bit splines and the complementary splines through which air can be exhausted.

12. An uphole hammer according to claim 11 wherein an annular sleeve is located inwardly of the bit retaining ring, having a radially inwardly extending rib located at or towards its innermost end.

13. An uphole hammer according to claim 12 wherein the piston is located within a piston chamber defined by the bottom end of the drill bit, the rib of the annular sleeve, the housing, and the upwardly facing axial face of the reduced diameter portion of the housing.

14. An uphole hammer according to claim 13 wherein the piston includes a body portion, a radially outwardly projecting rib located at the top end thereof, and a reduced diameter portion located between the body portion and the rib, wherein the rib is of a diameter complementary to the diameter of the rib of the annular sleeve to be slidably and sealingly engagable therewith, and wherein the diameter of the body portion is complementary to the diameter of the inner surface of the housing so as to be slidably and sealingly engagable therewith.

15. An uphole hammer according to claim 14 wherein the fluid porting means includes a first fluid outlet port and a set of second fluid outlet ports which are spaced axially along the fluid supply tube.

16. An uphole hammer according to claim 15 wherein the internal bore of the piston includes a pair of annular grooves spaced axially from each other, the first annular groove being associated with a set of substantially axially directed first passageways opening into the axial face formed by the reduced diameter portion of the piston, and the second annular groove being associated with a set of substantially axially directed second passageways which open into the bottom face of the piston towards said one end of the housing.

17. An uphole hammer according to claim 16 wherein the first annular groove communicates with the first fluid outlet port when the piston is in its impact position.

18. An uphole hammer according to claim 17 wherein the second set of fluid outlet ports includes two axially spaced ports such that the second annular groove communicates therewith as the piston moves towards said one end of the housing.

19. An uphole hammer according to claim 18 wherein the fluid supply tube includes a waisted portion on the exterior surface thereof at a position immediately prior to the position at which the piston reaches its impact position, such that the waisted portion permits fluid pressure generated in the space between the bottom end of the piston and said one end of the housing to be exhausted therefrom to between the internal bore of the piston and the exterior of the fluid supply tube and then to between the internal bore of the drill bit and the exterior of the fluid supply tube and, when the piston moves from its impact position to be exhausted, past the outside diameter of the drill bit and the internal diameter of the bit retaining ring and the drive sub-bit support.

20. An uphole hammer according to claim 19 wherein the outermost end of the drill bit is of a diameter complementary to that of the fluid supply tube such that there is a substantial sealing engagement therebetween, and wherein external fluid ports are provided in the cutting face of the drill bit which extend between the cutting face of the drill bit to the inner region of the drill bit that is in non sealing engagement with the exterior of the fluid supply tube to permit the exhaustion of the fluid therethrough.

* * * * *